US005588492A

United States Patent [19]

Fujiki

[11] Patent Number: 5,588,492

[45] **Date of Patent: *Dec. 31, 1996**

[54] HAND INJECTOR GAS FIRE EXTINGUISHER

[75] Inventor: Masaru Fujiki, Tokyo, Japan

[73] Assignee: Glory Kiki Co., Ltd., Himeji, Japan

[ * ] Notice: The term of this patent shall not extend beyond the expiration date of Pat. No. 5,505,266.

[21] Appl. No.: 318,296

[22] Filed: Oct. 5, 1994

[30] Foreign Application Priority Data

Apr. 7, 1994 [JP] Japan ..... 6-095883

[51] Int. Cl.[6] ..... A62C 35/02

[52] U.S. Cl. ..... 169/11; 169/30

[58] Field of Search ..... 169/11, 19, 30; 222/5

[56] References Cited

U.S. PATENT DOCUMENTS

| | | | |
|---|---|---|---|
| 3,889,752 | 6/1975 | Dunn | 169/59 |
| 3,893,514 | 7/1975 | Carhart et al. | 169/11 X |
| 4,972,910 | 11/1990 | Fujiki | 169/60 |
| 5,123,490 | 6/1992 | Jenne | 169/61 |

FOREIGN PATENT DOCUMENTS

| | | |
|---|---|---|
| 1240684 | 8/1960 | France . |
| 2-121680 | 5/1990 | Japan . |
| 373263 | 11/1963 | Switzerland . |

*Primary Examiner*—Andrew C. Pike
*Attorney, Agent, or Firm*—Browdy and Neimark

[57] ABSTRACT

A hand injector for extinguishing fires through a two-stage fire extinguishing operation consisting of a cooling fire extinguishing step and an oxygen deficiency fire extinguishing step uses a fire extinguishing gas, such as a liquified gas including carbon dioxide contained in a cylinder. The hand injector has a firing pin unit for breaking a seal member of the cylinder, a retainer for maintaining the firing pin unit in an inoperative state, and a retainer operating device for operating the retainer by a manual operation. The retainer is fixed at its head portion by a bolt screwed to an upper surface portion of a cylinder receiver. Leg portions of the retainer are fitted in a recess formed in an upper portion of a shaft. A firing pin is fixed to a lower end of the shaft. The retainer operating device consists of a cam, which is adapted to be turned manually, whereby the leg portions of the retainer are opened to operate the fire pin.

8 Claims, 4 Drawing Sheets

HAND INJECTOR GAS FIRE EXTINGUISHER

BACKGROUND OF THE INVENTION

1. Field of the Invention

The present invention relates to a hand injector for a fire gas extinguisher.

2. Description of the Prior Art

Various types of fire extinguishers have heretofore been produced. One known example of the fire extinguishers is a gas fire extinguisher which uses a cylinder filled with a fire extinguishing gas, such as a fluorocarbon gas or carbon dioxide in a liquefied state, and which is adapted to eject the gas as a fire extinguishing agent by manually breaking a seal member of this cylinder. The known fire extinguishers also include a fire extinguisher adapted to eject a powdered or water soluble fire extinguishing agent with a gas pressure.

Among these conventional fire extinguishers, a gas fire extinguisher is not simply operated by hand, so that a fire extinguishing action using the same takes much time. Regarding, especially, a gas fire extinguisher using a fluorocarbon gas, the discontinuance of use of the same gas was decided under the international treaty for the improvement of the global environment, and it is therefore necessary to develop a substitute for fluorocarbon gas. When a fire extinguisher adapted to eject a powdered or water soluble fire extinguishing agent is used, the machines, instruments, clothes, and documents installed, stored, and placed in a room are damaged greatly due to the deposition of the fire extinguishing agent thereon during a fire extinguishing operation.

SUMMARY OF THE INVENTION

Accordingly, it is an object of the present invention to provide a simple-to-operate hand injector gas fire extinguisher. The injector is capable of improving fire extinguishing performance by utilizing a two-stage fire extinguishing function. The first stage consists of a cooling fire extinguishing function based on a super-low subzero temperature due to the gasification latent heat occurring when a gas, such as a carbon dioxide gas, contained in a liquefied state in a cylinder is ejected and gasified. The second stage consists of an oxygen deficiency fire extinguishing function based on the oxygen deficient condition in a room or storage occurring due to the explosive expansion of a gasified liquefied-state gas. Both stages act to speed up a fire extinguishing operation.

Another object of the present invention is to provide a high performance hand injector gas fire extinguisher, capable of carrying out a fire extinguishing operation speedily without soiling various kinds of equipment, documents, curios, and objects of art in a room.

The hand injector gas fire extinguisher according to the present invention comprises a cylinder which is filled with a fire extinguishing gas in a liquid state containing at least one of carbon dioxide and nitrogen. The gas has a cooling fire extinguishing function based on the gasification latent heat of a gasified gas and an oxygen deficiency fire extinguishing function based on the expansion of the gasified gas. The cylinder is sealed with a seal member. The injector has a firing pin unit for breaking the seal member of the cylinder, a cylinder receiving unit for retaining the cylinder and supporting the fire pin unit, a retainer unit for maintaining the fire pin unit in a non-operated state, and a retainer operating device for releasing the retainer unit by a manual operation and thereby operating the fire pin unit.

The hand injector gas fire extinguisher according to the present invention is preferably formed so that the cylinder has a screwthread on the outer circumferential surface of a head portion thereof, which corresponds and engages a screw thread on an inner surface on one end of the cylinder receiving unit. The injector also has a hollow portion into which the seal member-carrying head portion of the cylinder is inserted from a first end of the hollow portion by engaging the thread on the cylinder with that on the inner surface of the cylinder receiving unit. The injector further has a through bore, the diameter of which is slightly smaller than that of the hollow portion, on a second end of and adjacent to the hollow portion. The hollow portion and through bore communicate with each other so that a joint portion thereof forms a stepped portion.

The hand injector gas fire extinguisher according to the present invention is preferably formed so that the firing pin unit consists of a shaft which has a flange at a first end thereof, and a recess, in which an O-ring is fitted, in a second end thereof. The shaft has a retainer recess, in which a retainer is fitted, in between the second end of the shaft and the O-ring-fitted recess. The shaft is inserted into the cylinder receiver so that flange-carrying end and recess-carrying end are respectively fitted in the hollow portion and through bore of the cylinder receiver. A firing pin projects from and is fixed to the second end of the shaft. A spring is provided in a normally compressed state between the flange of the shaft fitted in the cylinder receiver and the hollow portion and the stepped portion constituting the joint portion.

The hand injector gas fire extinguisher according to the present invention is preferably formed so that the firing pin has an axial through bore, the shaft being provided with an axial through bore communicating with the through bore in the firing pin. A nozzle is attached to the shaft so as to communicate with the through bore in the shaft.

The hand injector gas fire extinguisher according to the present invention is preferably formed so that the retainer unit consists of a bent retainer having a pair of leg portions capable of being fitted in the retainer recess. A bolt is inserted into and engaged with a fixing member.

The hand injector gas fire extinguisher according to the present invention is preferably formed so that the retainer operating device consists of a manual cam provided between the leg portions of the retainer, in such a manner that the leg portions can be opened by turning the cam pivotably around a pin supported on one end surface of the cylinder receiving unit. A safety pin is also provided vertically on one end surface of the cylinder receiving unit so as to maintain the leg portions in a normally unopenable condition.

The hand injector gas fire extinguisher according to the present invention is preferably formed so that the cam consists of a cam portion having a pair of vertical projections of a width substantially equal to a distance between the leg portions when unopened. The projections are opposed to each other so that they are spaced from each other by a distance equal to that between the leg portions when moved to an opened state, and a manual lever portion joined to the cam portion.

The hand injector gas fire extinguisher according to the present invention can also be so formed that the retainer operating device consists of a tapering shaft member provided between the leg portions of the retainer by a push-button shaft member inserted through the tapering shaft member and loosely fitted in the guide bore in the cylinder receiver.

The hand injector gas fire extinguisher according to the present invention is preferably formed so that the cylinder receiver has a flange at one end portion thereof, and a locking recess in the outer circumferential surface of the flange.

The hand injector gas fire extinguisher according to the present invention is preferably formed so that the hand injector is provided with a case consisting of a mounting plate having a holder engageable with the recess in the outer circumferential surface of the flange of the cylinder receiver, and a cover attached to the mounting plate so that the cover can be opened and closed. The injector body which consists of the cylinder, cylinder receiving unit, firing pin unit, retainer unit, and retainer operating device are held in the case by fitting the recess in the outer circumferential surface of the flange of the cylinder receiver over the holder of the mounting plate.

The preferred mode of embodiment of the hand injector gas fire extinguisher according to the present invention comprises a seal member-carrying cylinder provided with a thread on the outer circumferential surface of a head portion thereof and a cylinder receiver having a thread, which corresponds and engages a thread on an inner surface on one end of the cylinder. A flange is provided on the other end of the cylinder receiver. A locking recess is provided in the outer circumferential surface of the flange. The cylinder receiver has a hollow portion into which the seal member-carrying head portion of the cylinder is inserted from one end thereof by engaging the thread on the cylinder with that on the inner side of the first-mentioned end portion of the cylinder receiver. The cylinder receiver further has a through bore, the diameter of which is slightly smaller than that of the hollow portion, on another end and adjacent to the hollow portion. The hollow portion and through bore communicate with each other so that a joint portion thereof forms a stepper portion. A shaft which has an axial through bore is provided with a flange at a first end thereof, a recess, in which an O-ring is fitted, in the second end thereof, and a retainer recess, in which a retainer is fitted, between the second end and the O-ring-fitted recess. The shaft is inserted into the cylinder receiver so that the flange-carrying end portion and the recess-carrying end portion are respectively fitted in the hollow portion and the through bore in the cylinder receiver. A firing pin has a through bore therein and projects from and is fixed to the first end of the shaft. A nozzle is fixed to the shaft. A spring is provided in a normally compressed state between the flange of the shaft fitted in the cylinder receiver and hollow portion and the stepped portion constituting the joint portion. A pair of leg portions of a bent retainer are capable of being fitted in the retainer recess in the shaft. A bolt is provided for fixing the head portion of the retainer to one end surface of the shaft. A manual cam is provided which consists of a cam portion having a pair of vertical projections of a width substantially equal to a distance between the leg portions when unopened. The projections are opposed to each other by a distance equal to that between the leg portions when moved to an opened state. A manual lever portion joined to the cam portion is provided between the leg portions which constitute the retainer, in such a manner that these leg portions can be thereby opened. A pin is provided to support the cam pivotably on one end surface of the cylinder receiver. Safety pins are provided vertically on one end surface of the cylinder receiving unit so as to maintain the leg portions in a normally unopenable condition. The hand injector is provided with a case which consists of a mounting plate having a holder engageable with the annular recess in the outer circumferential surface of the flange of the cylinder receiver, and a cover attached to the mounting plate so that the cover can be opened and closed. The injector body, which consists of the cylinder, cylinder receiver, shaft, firing pin, nozzle, spring, retainer, bolt, cam, and safety pin, with the manual lever projected operably to the outside and with the nozzle opened at its upper portion, are held in the case by fitting the recess in the outer circumferential surface of the flange of the cylinder receiver over the holder of the mounting plate.

Another preferred mode of embodiment of the hand injector gas fire extinguisher according to the present invention comprises a tapering shaft member rather than the above described cam to open the retainer and discharge the extinguisher. As was the cam, the tapering shaft member is provided between said leg portions of the retainer, in such a manner that said leg portions can be opened. This is achieved by a push-button shaft member inserted through said tapering shaft member and loosely fitted in the guide bore in said cylinder receiver. Safety pins are provided vertically on one end surface of said cylinder receiver so as to maintain said leg portions in a normally unopenable condition.

The hand injector gas fire extinguisher according to the present invention is set in a predetermined position in a room, a storage, and a cabinet, to be more precise, a computer room; an engine room; a motor compartment, a panel room, a power source compartment, and a boiler room in a ship and a vehicle; a container for inflammables; an automatic generator room; a heater room; a depository for valuables; a library; a work of art storage room; and a cabinet for inflammable electric appliances and gas fittings. The number of the hand injectors for gas fire extinguishers to be set is regulated suitably on the basis of the capacity of a room, a storage, and a cabinet.

The hand injector gas fire extinguisher according to the present invention is fixed to a wall surface with, for example, an injector body held in a case. When a fire occurs in a room in which this hand injector gas fire extinguisher is set, the hand injector is directed toward the fire with the hand injector left fixed to the wall surface or removed therefrom, and the retainer operating device is operated manually. Consequently, the retainer is opened by the cam portion of the cam or the tapering shaft member, and the firing pin-carrying shaft is moved down by the spring provided between the cylinder receiver and shaft. The downward movement of the shaft causes the firing pin to be moved down suddenly to break the seal member of the cylinder. The cylinder is thus unsealed, and the fire extinguishing gas with which the cylinder is filled is ejected. The resultant gas is ejected from the nozzle provided at the upper end portion of the shaft. When the ejection of the fire extinguishing gas is started, the user can stay in the room and continue to eject the gas toward the fire in a case where the origin of the fire is limited, or he can leave the room with the hand injector left fixed to the wall surface in the room in a case where the flames extend widely therein. In any case, the temperature of the ejected and gasified gas becomes super-low to cause the temperature in the space of the origin of the fire or the whole space in the room to decrease suddenly, whereby a cooling fire extinguishing operation is carried out. The gasification gas expands explosively to put the interior of a room or storage in an oxygen deficient condition, whereby an oxygen deficiency fire extinguishing operation is carried out.

The hand injector gas fire extinguisher according to the present invention enables a fire extinguishing operation to be started speedily by breaking the seal member simply by operating a cam by a manual lever, or pressing a push-button. Therefore, the time between the breakage of the seal member and the starting of ejection of the fire extinguishing is short, and a fire extinguishing operation is started very speedily. Moreover, the fire extinguishing gas used in the present invention does not cause various kinds of equipment, important goods, and documents to be placed under water and soiled.

The above and other objects features and advantages of the present invention will become apparent form the following detailed description which is to be read in conjunction with the accompanying drawings.

DESCRIPTION OF THE PREFERRED EMBODIMENTS

Figure 1:
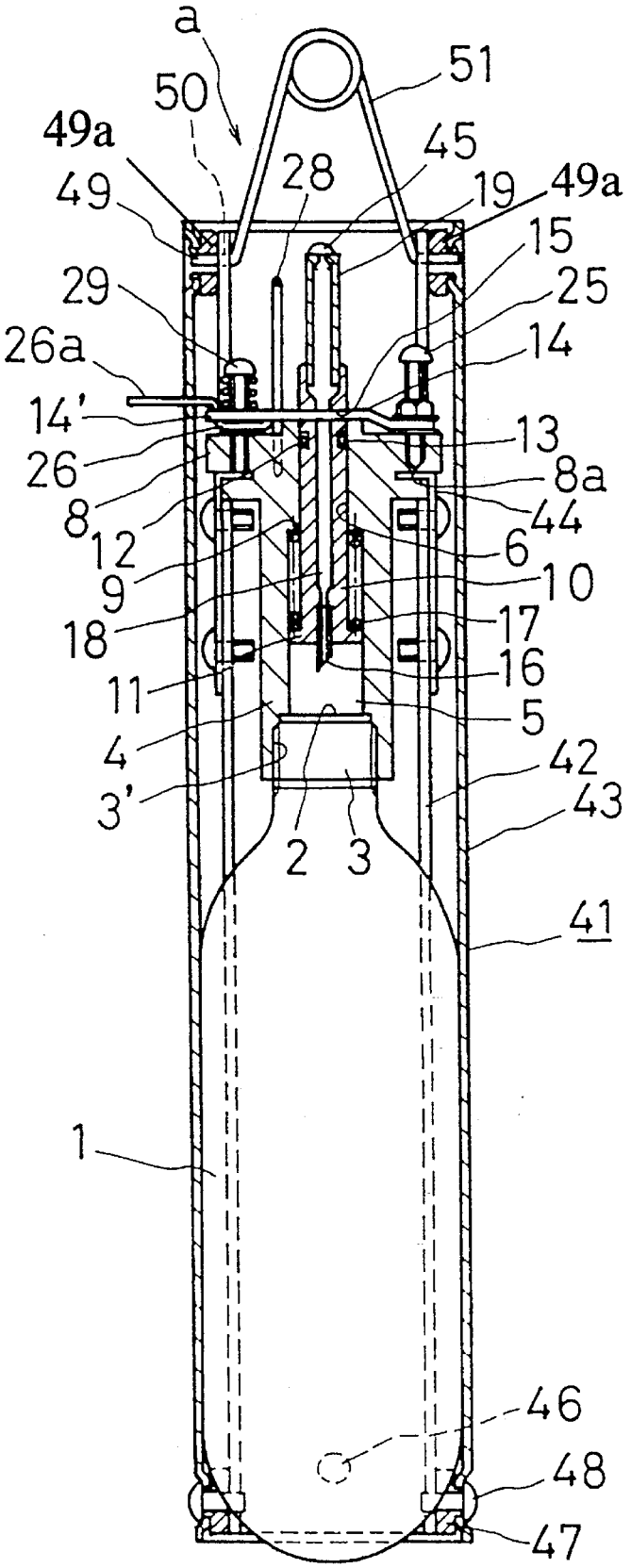
FIG. 1 is a sectioned front elevation of an embodiment of the hand injector gas fire extinguisher according to the present invention.
Figure 2:
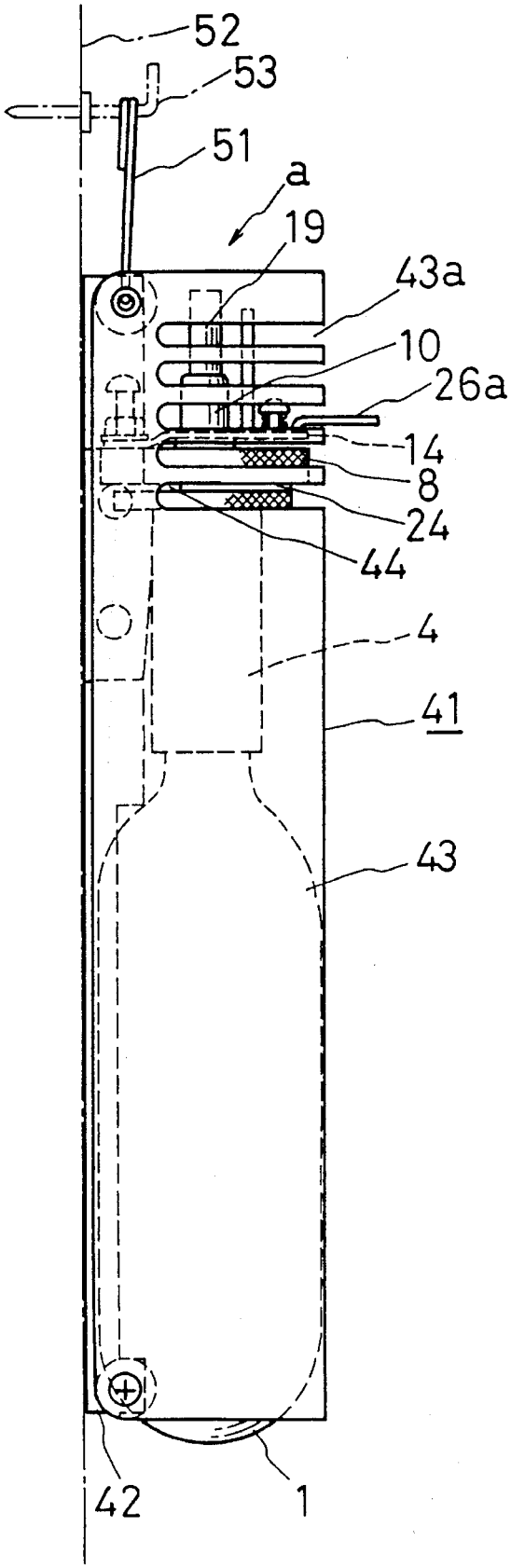
FIG. 2 is a side elevation of the embodiment of FIG. 1.
Figure 3:
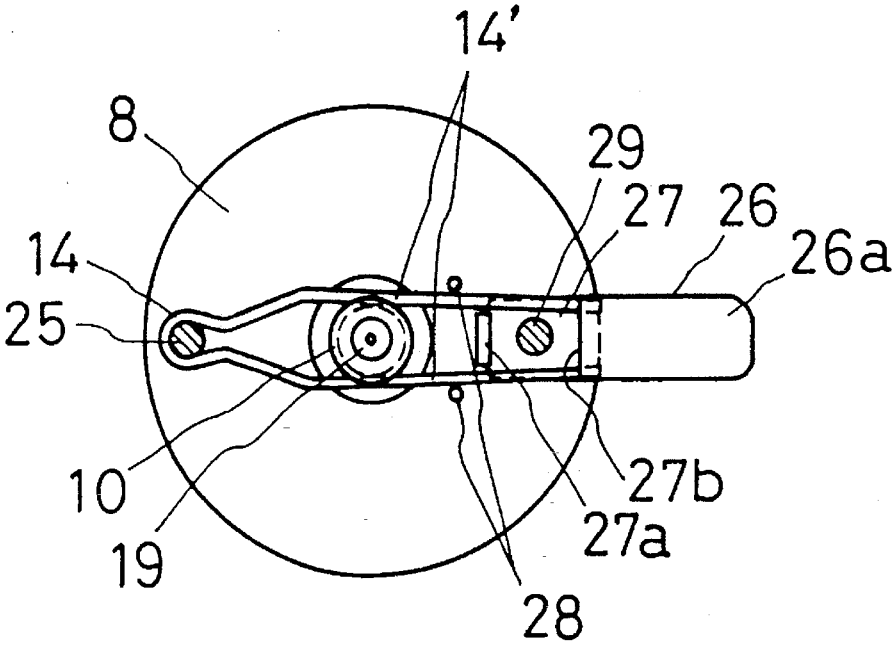
FIG. 3 is a plan view of an injector body in the embodiment of FIG. 1.

An embodiment of the hand injector gas fire extinguisher according to the present invention will now be described with reference to the drawings.

Referring to the drawings, a reference letter a denotes a hand injector gas fire extinguisher provided with a cylinder 1 filled with carbon dioxide, nitrogen, or a gas consisting of a mixture thereof in a liquefied state as a fire extinguishing gas, and sealed with a seal member 2. When this kind of gas is gasified, the temperature thereof becomes super-low (for example, −30° ~−40° C.), and it therefore has a cooling fire extinguishing function. Since such a gas expands explosively (for example, 500 times) with respect to the volume of the same in a liquefied state due to the gasification thereof, it also has an oxygen deficiency fire extinguishing function. In order to have, for example, the interior of a room ready for a fire extinguishing operation, the equipment in the room is regulated so that the gasification quantity of a gas becomes about ¼ of the volume of the room, whereby the oxygen deficiency fire extinguishing function is displayed. The oxygen deficiency fire extinguishing effect is obtained by reducing the oxygen in a room from 21% to around 15%. A thread 3 is provided on the outer circumferential surface of a head portion of the cylinder 1.

The hand injector gas fire extinguisher is also provided with a cylinder receiver 4 for fixing the cylinder 1 thereto and retaining the same. The cylinder receiver 4 has a hollow portion 5 in the inner side thereof, and an axial through bore 6, which communicates with the hollow portion 5, in an upper end portion thereof. The cylinder receiver 4 is also provided with a thread 3', which is engageable with that on a head portion of the cylinder 1, on the inner side of a lower end portion thereof. The upper end portion of the cylinder receiver 4 is provided with a flange 8 the diameter of which is increased in two steps. The flange 8 is provided with an annular recess **8*a* in the outer circumferential surface thereof. The hollow portion 5 is formed to a diameter larger than that of the through bore 6 so that a joint portion of these two forms a stepped portion 9**.

A shaft 10 is inserted from the lower end of the cylinder receiver 4 so as to pass through the hollow portion 5 and through bore 6. A lower end portion, which is inserted in the hollow portion 5, of the shaft 10 has a flange 11, while an upper portion thereof which is fitted in the through bore 6 has a recess 13 for fitting an O-ring 12 therein. The shaft 10 is further provided in the portion thereof which is above the recess 13 with a recess 15 for fitting leg portion 14' of a bent retainer 14 therein. A firing pin 16 of a hollow structure, an inner through hollow of which extends axially, is projected from one end portion of the shaft 10. The shaft 10 has an axially extending through bore 18 therein, and lower and upper end portions of this through bore 18 communicate with the hollow of the firing pin 16 and a nozzle 19, which is fixed to a head portion of the shaft 10, respectively. A spring 17 is fitted in the shaft 10. The shaft 10 is lifted so that the spring 17 is compressed between the flange 11 of the shaft 10 fitted in the hollow portion 5 and the stepped portion 9 of the cylinder receiver 4, and the leg portions 14' of the retainer 14 are fitted in the recess 13 with the shaft 10 in the mentioned condition.

An attachment 24 is fitted in one side portion of the annular recess **8*a* in the flange 8 of the cylinder receiver 4** with a holder-fitting portion left empty.

The bent retainer 14 is fixed at its head portion by a bolt 25 screwed to a peripheral portion of the upper surface of the cylinder receiver 4. The retainer 14 consists of a spring material and has a pair of leg portions 14' extending from the head portion thereof in the same direction. These leg portions 14' extend so as to normally hold from both sides a cam portion 27 of a cam 26 provided in the part of the peripheral portion of the upper surface of the cylinder receiver 4 which is on the opposite side of the bolt 25. The leg portions 14' of the retainer 14 in this condition are fitted in the recess 15 in the shaft 10 to prevent the shaft from being moved down.

The cam portion 27 of the cam 26 has a pair of vertical projections **27*a*, 27*b* which have a width substantially equal to the distance between the leg portions 14' in a non-opened state of the retainer 14. These projections 27*a*, 27*b* are provided in an opposed state so that they are spaced from each other by a distance corresponding to that between the leg portions 14' when moved to an opened state of the retainer 14. The cam 26 has a manual lever portion 26*a* joined to an upper edge of one projection 27*b* of the cam portion 27. Safety pins 28 for maintaining the leg portions 14' of the retainer 14 in a non-opened state are fitted firmly and removably in an upper surface of the cylinder receiver 4. The cam 26 is supported pivotably by a pin 29 screwed to the upper surface of the cylinder receiver 4**.

These parts form an injector body. The hand injector gas fire extinguisher in this embodiment has an injector body constructed as described above, which is housed in a case 41.

The case 41 consists of a mounting plate 42, and a cover 43 attached to the mounting plate 42 so that the cover 43 can be opened and closed. The mounting plate 42 is formed in the shape of a guide rail so that a side portion of the cylinder 1 is fitted shallowly therein, and it is provided at its upper portion with a holder 44 for retaining the injector body by fitting the holder in the recess **8*a* in the flange 8 of the cylinder receiver 4. The mounting plate 42 is provided in the upper and lower end portions thereof with bores 45, 46 via which the mounting plate is fixed to a wall surface. The cover 43 is formed by bending a flat plate to a cross-sectionally U-shaped structure, and lower end portions of left and right parts thereof are joined to the mounting plate 42 by pins 48 via washers 47 so that the cover 43 can be opened and closed at an upper end thereof in the longitudinal direction. The upper end portions of the left and right parts of the cover 43 and mounting plate 42 are provided with pin holes 49, 50 which are aligned with each other when the cover 43 is closed, and washers 49***a* are fixed to the portions of the inner surface of the cover 43 which correspond to the pin holes 49. The pin holes 49 in the cover 43 and those 50 in the mounting plate 42 are aligned with each other with the cover 43 in a closed condition. An injector suspending case hook 51 consisting of a spring pin is fitted firmly in these pin holes 49, 50. The case 41 with the case hook 51 fixed thereto in this manner can be suspended from a peg member 53 driven into a wall surface 52 in a room via the case hook 51. The cover 43 is provided in an upper portion thereof with a plurality of slit type openings 43*a*. The manual lever portion 26*a* projects to the outside operably with the recess 8*a* in the flange 8 of the cylinder receiver 4 fitted around the upper end portion of the holder 44 and with the cover 43 closed.

Figure 4:
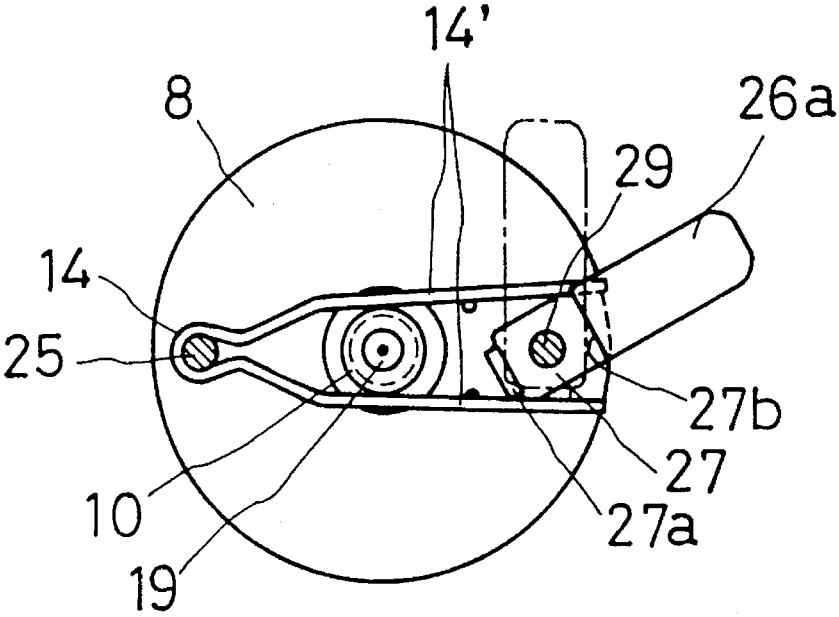
FIG. 4 is a plan view showing an operated condition of a retainer operating device in the embodiment of FIG. 1.

The hand injector gas fire extinguisher is fixed to the wall surface 52 with, for example, the injector body housed in the case 41. When a fire occurs, the manual lever portion 26*a* of the cam 26 is operated by hand so as to turn the cam 26 as shown in FIG. 4. Consequently, the leg portions 14' of the retainer 14 are opened by the cam portion 27 of the cam 26, so that the shaft 10 the flying of which is prevented by the retainer 14 moves down owing to the stretching force of the spring 17. The downward movement of the shaft 10 causes the firing pin 5 to move down suddenly to break the seal member 2 of the cylinder 1. The fire extinguishing gas contained in the cylinder 1 is then ejected.

Figure 5:
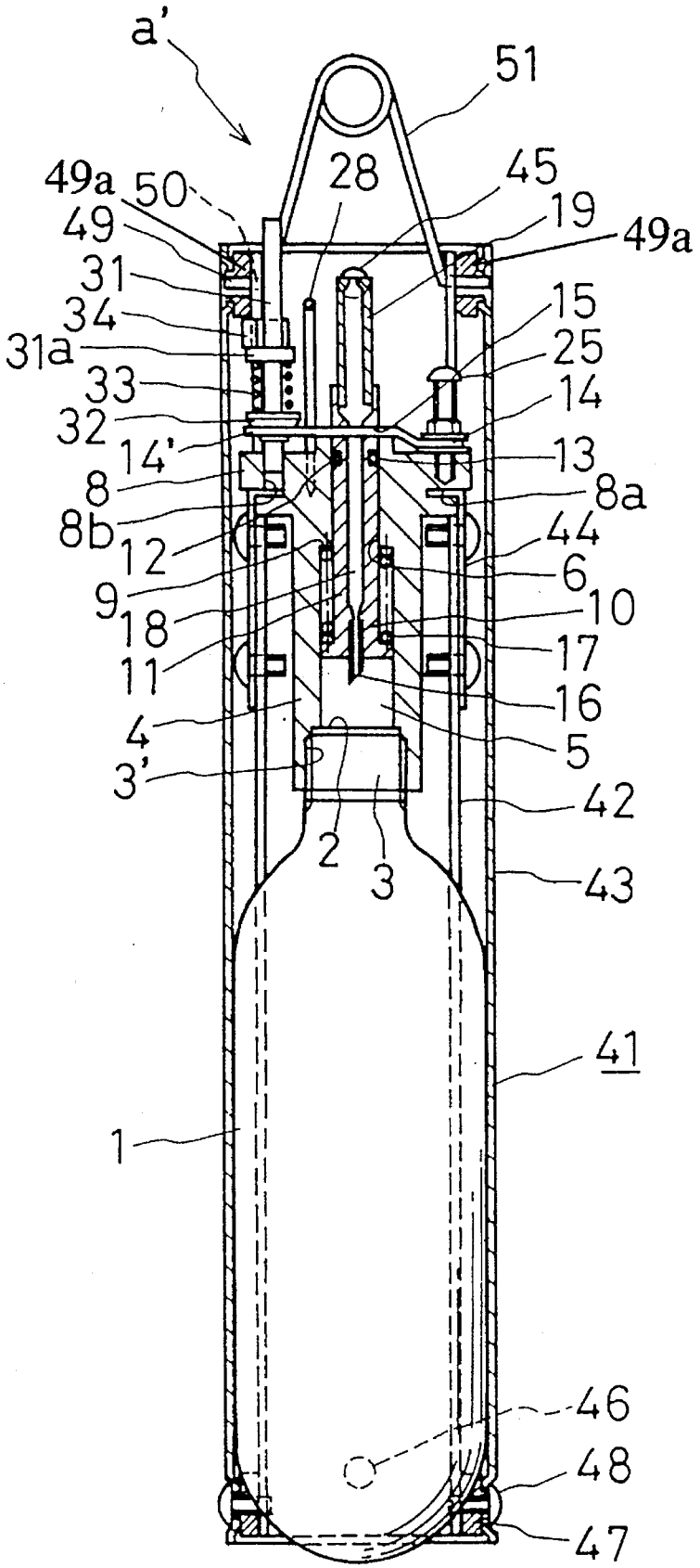
FIG. 5 is a sectioned front elevation of another embodiment of the hand injector gas fire extinguisher according to the present invention.

FIG. 5 shows another preferred embodiment of the hand injector gas fire extinguisher according to the present invention.

In this embodiment, a tapering shaft member 32 through which a push-button shaft member 31 is passed is provided between leg portions 14' of a retainer 14 so that the leg portions 14' can be opened, and the push-button shaft member 31 is fitted loosely in a guide bore 86 in a flange 8 of a cylinder receiver 4 so that the push-button shaft member 31 can be axially moved. A spring 33 is fitted around the push-button shaft member 31 and set between the tapering shaft member 32 and a flange 31*a* of the push-button shaft member 31. A stopper 34 is fixed to the portion of a mounting plate 42 which is on the side of a case 41 so as to retain the push-button shaft 31. The stopper 34 may also be fixed to the portion of the mounting plate 42 which is on the side of the cylinder receiver 4. The construction of the other parts is identical with the corresponding parts of the previously-described embodiment.

In the embodiment of FIG. 5, safety pin 28 is removed and a push-button 31 is pressed by hand. Consequently, the tapering shaft member 32 is pressed via the spring 33 to cause the leg portions 14' of the retainer 14 to be opened, and the shaft 10 the flying of which is prevented by the retainer 14 to be moved down owing to the stretching force of a spring 17. The downward movement of the shaft 10 causes a firing pin 5 to be moved down suddenly, by which a seal member 2 of a cylinder 1 is broken. A fire extinguishing gas contained in the cylinder 1 is then ejected.

It will be appreciated that modifications may be made in our invention.

For example, ejection ports can be provided in the cylinder receiver, and nozzles attached to these ejection ports. The hand injector can also be formed so as to direct the ejected gas downward by providing ejection ports in the cylinder receiver, and a cylindrical member on the outer side of the cylinder receiver.

Accordingly, it should be understood that I intend to cover by the appended claims all modifications falling within the true spirit and scope of my invention.

What is claimed is:

1. A hand injector gas fire extinguisher comprising a hand injector and a cylinder which is filled only with a fire extinguishing gas in a liquid state having a cooling fire extinguishing function based on gasification latent heat of a liquified gas when gasified and an oxygen deficiency fire extinguishing function based on expansion thereof and which is sealed at a head portion of said cylinder with a seal member, said hand injector having a firing pin unit for breaking said seal member of said cylinder, a cylinder receiving unit for retaining said cylinder and supporting said firing pin unit, a retainer unit for maintaining said firing pin unit in an inoperative state, and a retainer operating device for releasing said retainer unit by a manual operation and thereby operating said firing pin unit, wherein said cylinder has a thread on an outer circumferential surface of said head portion thereof, said thread corresponding and engaging a thread on an inner surface on a first end of said cylinder receiving unit, said cylinder receiving unit consisting of a cylinder receiver having a hollow portion into which said head portion is inserted from a first end of said hollow portion by engaging said thread on said cylinder with the thread on the inner surface of a first end of said cylinder receiver, said cylinder receiver also having a through bore, a diameter of said through bore being slightly smaller than that of said hallow portion on a second end of said cylinder receiver and adjacent to said hollow portion; said hollow portion and said through bore communicating with each other so that a joint portion thereof forms a stepped portion, wherein said firing pin unit consists of:

a shaft which has a flange at a first end thereof, and a recess in which an O-ring is fitted on a second end thereof, the shaft further having a retainer recess in which the retainer unit is fitted in between the second end of said shaft and said O-ring- fitted recess, the shaft being inserted into said cylinder receiver so that the first end of the shaft and the second end of the shaft are respectively fitted in said hollow portion and said through bore of said cylinder receiver;

a firing pin projecting from and fixed to the first end of said shaft; and a spring provided in a normally compressed state between said flange of said shaft fitted in said cylinder receiver and said hollow portion and said stepped portion constituting said joint portion, wherein said retainer unit consists of a bent retainer having a pair of leg portions engaged in said retainer recess, and a bolt inserted through a head portion of said retainer unit fixing said head portion to the second end of the cylinder receiver, wherein said retainer operating device consists of a manual cam engaged between said leg portions of said bent retainer, in such a manner that said leg portions can be opened by turning said cam pivotably around on a surface of a second end of said cylinder receiving unit, and a safety pin provided vertically on the second end of said cylinder receiving unit so as to maintain said leg portions in a normally unopenable condition, wherein said cam consists of a cam portion having a pair of vertical projections having a width substantially equal to a distance between said leg portions, said projections being opposite each other so that they are spaced from each other by a distance equal to that between said leg portions when moved to an open state, and a manual lever portion joined to said cam portion.

2. The hand injector gas fire extinguisher according to claim 1 wherein said fire extinguishing gas is carbon dioxide.

3. The hand injector gas fire extinguisher according to claim 1 wherein said fire extinguishing gas is nitrogen.

4. The hand injector gas fire extinguisher according to claim 1 wherein said fire extinguishing gas is carbon dioxide and nitrogen.

5. The hand injector gas fire extinguisher according to claim 1, wherein said firing pin has an axial through bore, and said shaft has an axial through bore communicating with said through bore in said firing pin, a nozzle being attached to said shaft so as to communicate with said through bore in said shaft.

6. The hand injector fire extinguisher according to claim 1, wherein said cylinder receiver has a flange at said second end thereof, and a locking recess in an outer circumferential surface of said flange.

7. The hand injector gas fire extinguisher according to claim 6, further comprising a case housing said extinguisher and consisting of a mounting plate having a holder engageable with said recess in the outer circumferential surface of said flange of said cylinder receiver, and a cover attached to said mounting plate so that said cover can be opened and closed, said hand injector being held in said case by fitting said recess in the outer circumferential surface of said flange of said cylinder receiver on said holder of said mounting plate.

8. A hand injector gas fire extinguisher comprising a cylinder provided with a thread on an outer circumferential surface of a head portion thereof;

a seal member with which said cylinder is sealed at said head portion thereof;

a cylinder receiver having a thread, which is engageable with said thread on said cylinder, on an inner side of a first end thereof, a flange on a second end of said cylinder receiver, a locking recess in an outer circumferential surface of said flange, a hollow portion into which said head portion of said cylinder is inserted from a first end of said hollow portion by engaging said thread on said cylinder with that on of the first end of said cylinder receiver, a through bore of which diameter is slightly smaller than that of said hollow portion, on said second end of said cylinder receiver and adjacent to said hollow portion, said hollow portion and said through bore communicating with each other so that a joint portion thereof forms a stepped portion;

a shaft which has an axial through bore, a flange at a first end thereof, and a recess, in which an O-ring is fitted, in a second end thereof, a retainer recess, in which a retainer unit is fitted in between the second end of the shaft and said O-ring-fitted recess, the shaft being inserted into said cylinder receiver so that said first end of the shaft and said second end of the shaft are respectively fitted in said hollow portion and said through bore of said cylinder receiver;

a firing pin having a through bore therein, and projecting from and fixed to the first end of said shaft;

a nozzle fixed to said shaft;

a spring provided in a normally compressed state between said flange of said shaft fitted in said cylinder receiver and said hollow portion and said stepped portion constituting said joint portion, said retainer unit comprising a bent retainer having a pair of leg portions engaged in said retainer recess in said shaft;

a bolt for fixing a head portion of said bent retainer to the second end of said cylinder receiver, a manual cam having a cam portion having a pair of vertical projections with a width substantially equal to a distance between said leg portions before being opened, a manual lever portion joined to said cam portion, said cam portion being engaged between said leg portions in such a manner that said leg portions can be thereby opened by turning said manual lever, a pin supporting said cam pivotably on the second end of said cylinder receiver, and a safety pin provided vertically on the second end of said cylinder receiver to maintain said leg portions in a normally unopenable condition; and a case comprising a mounting plate having a holder engageable with an annular recess in the outer circumferential surface of said flange of said cylinder receiver, and a cover attached to said mounting plate so that said cover can be opened and closed, said case housing said hand injector gas fire extinguisher by fitting said locking recess in the outer circumferential surface of said flange of said cylinder receiver on said holder of said mounting plate.

* * * * *